US011105128B2

(12) United States Patent
Manolescu et al.

(10) Patent No.: US 11,105,128 B2
(45) Date of Patent: Aug. 31, 2021

(54) DOOR LATCH WITH CLUTCH SELECTIVELY ENGAGED BY MAGNETIC FIELD

(71) Applicant: Ford Global Technologies, LLC, Dearborn, MI (US)

(72) Inventors: Constantin Manolescu, Rochester Hills, MI (US); Kosta Papanikolaou, Huntington Woods, MI (US); Erin Rose Briggs, Detroit, MI (US); David Manuel Rogers, Ferndale, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 668 days.

(21) Appl. No.: 15/907,403

(22) Filed: Feb. 28, 2018

(65) Prior Publication Data

US 2019/0264477 A1 Aug. 29, 2019

(51) Int. Cl.

| | |
|---|---|
| ***E05B 85/26*** | (2014.01) |
| ***E05B 81/54*** | (2014.01) |
| ***E05C 3/00*** | (2006.01) |
| ***E05B 85/24*** | (2014.01) |
| ***E05B 83/36*** | (2014.01) |

(52) U.S. Cl.

CPC ..... *E05B 85/26* (2013.01); *E05B 81/54* (2013.01); *E05B 83/36* (2013.01); *E05B 85/243* (2013.01); *E05C 3/004* (2013.01)

(58) Field of Classification Search

CPC ..... E05B 81/14; E05B 2047/0028; E05B 15/0046; E05B 2047/0026; E05B 47/00; E05B 47/0012; E05B 81/06; E05B 81/46; Y10T 292/1082; E05Y 2201/434; E05Y 2201/462; F16D 37/02

See application file for complete search history.

(56) References Cited

U.S. PATENT DOCUMENTS

| | | | | |
|---|---|---|---|---|
| 6,038,895 | A | 3/2000 | Menke et al. | |
| 7,287,785 | B2 | 10/2007 | Schupp et al. | |
| 7,401,483 | B2 * | 7/2008 | Dimig | E05B 81/00 335/285 |
| 7,969,705 | B2 * | 6/2011 | Dimig | H01F 7/04 361/143 |
| 8,403,124 | B2 * | 3/2013 | Dimig | F16D 27/112 192/84.9 |
| 8,528,950 | B2 * | 9/2013 | Organek | E05B 17/007 292/216 |
| 8,561,443 | B2 | 10/2013 | Sun et al. | |
| 9,260,882 | B2 | 2/2016 | Krishnan et al. | |
| 2005/0134052 | A1 | 6/2005 | Spurr et al. | |
| 2006/0220393 | A1 * | 10/2006 | Dimig | B60R 25/08 292/251.5 |

(Continued)

FOREIGN PATENT DOCUMENTS

DE 102013109040 A1 8/2013

*Primary Examiner* — Mark A Williams

(74) *Attorney, Agent, or Firm* — David Coppiellie; Carlson, Gaskey & Olds, P.C.

(57) ABSTRACT

A door latch for a motor vehicle according to an exemplary aspect of the present disclosure includes, among other things, a pawl, a release lever, and a clutch selectively engaged by a magnetic field. Further, when the clutch is engaged, motion of the release lever is transmitted to the pawl via the clutch. A method is also disclosed.

20 Claims, 5 Drawing Sheets

(56) References Cited

U.S. PATENT DOCUMENTS

| | | | | |
|---|---|---|---|---|
| 2006/0226941 | A1* | 10/2006 | Dimig | H01F 7/04 335/220 |
| 2006/0226942 | A1* | 10/2006 | Dimig | B60R 25/02 335/220 |
| 2008/0029634 | A1* | 2/2008 | Kim | B60R 22/41 242/383.4 |
| 2008/0164703 | A1* | 7/2008 | Aubry | E05B 81/20 292/201 |
| 2012/0299313 | A1* | 11/2012 | Organek | E05B 81/20 292/129 |
| 2016/0251888 | A1* | 9/2016 | Makino | E05B 83/40 49/280 |

* cited by examiner

DOOR LATCH WITH CLUTCH SELECTIVELY ENGAGED BY MAGNETIC FIELD

TECHNICAL FIELD

This disclosure relates to a door latch for a door of a motor vehicle, and a corresponding method. The door latch includes a clutch selectively engaged by a magnetic field.

BACKGROUND

Motor vehicles are known to include doors with handles, which are pulled in order to manually open the door. Typically, the handles are coupled to a cable or rod, which is in turn coupled to a door latch. The door latch is configured to cooperate with a striker pin, which is typically mounted to a vehicle body. When the handle is pulled, the cable or rod actuates the door latch, causing the door latch to release the striker pin, thereby allowing a user to open the door.

SUMMARY

A door latch for a motor vehicle according to an exemplary aspect of the present disclosure includes, among other things, a pawl, a release lever, and a clutch selectively engaged by a magnetic field. Further, when the clutch is engaged, motion of the release lever is transmitted to the pawl via the clutch.

In a further non-limiting embodiment of the foregoing door latch, when the clutch is disengaged, motion of the release lever is not transmitted to the pawl.

In a further non-limiting embodiment of any of the foregoing door latches, the clutch includes a coupling wheel and a pawl lifter, the coupling wheel is configured to contact the release lever, the pawl lifter is configured to contact the pawl, and when the clutch is engaged, motion of the coupling wheel is transmitted to the pawl lifter.

In a further non-limiting embodiment of any of the foregoing door latches, when the clutch is disengaged, motion of the coupling wheel is not transmitted to the pawl lifter.

In a further non-limiting embodiment of any of the foregoing door latches, the door latch includes a magnetic field generator configured to selectively generate the magnetic field.

In a further non-limiting embodiment of any of the foregoing door latches, the magnetic field generator includes an electromagnet at least partially within the pawl lifter.

In a further non-limiting embodiment of any of the foregoing door latches, the coupling wheel includes a material attracted to the magnetic field such that, when the magnetic field is present, rotation of the coupling wheel results in rotation of the pawl lifter.

In a further non-limiting embodiment of any of the foregoing door latches, the release lever includes an arm and a tooth, the coupling wheel includes a tooth configured to contact the arm of the release lever, and the pawl lifter includes a tooth configured to contact with the tooth of the release lever.

In a further non-limiting embodiment of any of the foregoing door latches, the arm of the release lever is longer than the tooth of the release lever, and the arm of the release lever is circumferentially and axially spaced-apart from the tooth of the release lever.

In a further non-limiting embodiment of any of the foregoing door latches, when the clutch is engaged the arm of the release lever contacts the tooth of the coupling wheel as the release lever rotates from a home position to a first rotational position, and the tooth of the release lever contacts the tooth of the pawl lifter as the release lever rotates from the first rotational position to a second rotational position.

In a further non-limiting embodiment of any of the foregoing door latches, when the clutch is engaged, the arm of the release lever releases from the tooth of the coupling wheel at a point between the first rotational position and the second rotational position.

In a further non-limiting embodiment of any of the foregoing door latches, when the clutch is engaged, rotation of the release lever to the second rotational position causes the pawl lifter to contact the pawl such that the pawl releases a fork bolt.

In a further non-limiting embodiment of any of the foregoing door latches, the pawl lifter includes an arm configured to contact the pawl.

In a further non-limiting embodiment of any of the foregoing door latches, when the clutch is disengaged the arm of the release lever contacts the tooth of the coupling wheel as the release lever rotates, and the tooth of the release lever bypasses the tooth of the pawl lifter as the release lever rotates.

A motor vehicle according to an exemplary aspect of the present disclosure includes, among other things, a body including a striker pin, and a door configured to open and close relative to the body. The door including a door latch, which includes a fork bolt configured to receive the striker pin when the door is closed, a pawl configured to hold the fork bolt to keep the door closed, a release lever, and a clutch selectively engaged by a magnetic field. Further, when the clutch is engaged, motion of the release lever is transmitted to the pawl via the clutch such that the pawl releases the fork bolt, thereby allowing the door to open.

In a further non-limiting embodiment of the foregoing motor vehicle, the door includes a door handle, and wherein the release lever is coupled to the door handle.

A method according to an exemplary aspect of the present disclosure includes, among other things, engaging a clutch by generating a magnetic field, and transmitting motion of a release lever to a pawl via the clutch, the pawl configured to release a fork bolt, thereby allowing a door to open.

In a further non-limiting embodiment of the foregoing method, the clutch includes a coupling wheel and a pawl lifter, and the step of transmitting motion includes rotating the release lever from a home position to a first rotational position, the release lever contacting the coupling wheel between the home position and the first rotational position, and rotating the release lever from the first rotational position to a second rotational position, the release lever contacting the pawl lifter between the first rotational position and the second rotational position.

In a further non-limiting embodiment of any of the foregoing methods, the method includes releasing the release lever from the coupling wheel at a point between the first rotational position and the second rotational position.

In a further non-limiting embodiment of any of the foregoing methods, the method includes disengaging the clutch by ceasing to generate a magnetic field, thereby preventing transmission of motion of the release lever to the pawl.

BRIEF DESCRIPTION OF THE DRAWINGS

FIG. 5A illustrates the door latch in a locked state and in a home position.

FIG. 5B illustrates the door latch in a locked state and in a bypass position.

FIG. 5C illustrates the door latch in a locked state and in a full travel position.

FIG. 6A illustrates the door latch in an unlocked state and in a home position.

FIG. 6B illustrates the door latch in an unlocked state and in a first rotational position.

FIG. 6C illustrates the door latch in an unlocked state and at a point between a first rotational position and a second rotational position.

FIG. 6D illustrates the door latch in an unlocked state and in a second rotational position.

DETAILED DESCRIPTION

This disclosure relates to a door latch for a door of a motor vehicle, and a corresponding method. An example door latch includes a pawl, a release lever, and a clutch selectively engaged by a magnetic field. When the clutch is engaged, motion of the release lever is transmitted to the pawl via the clutch. In turn, the pawl releases a fork bolt, thereby allowing the door to open. This disclosure provides a number of benefits over the prior art. Namely, the disclosed door latch is simpler, more compact, and includes fewer component parts than prior door latches. Thus, the disclosed door latch is less expensive and easier to manufacture than prior door latches. Additional benefits will be appreciated from the below.

Figure 1:
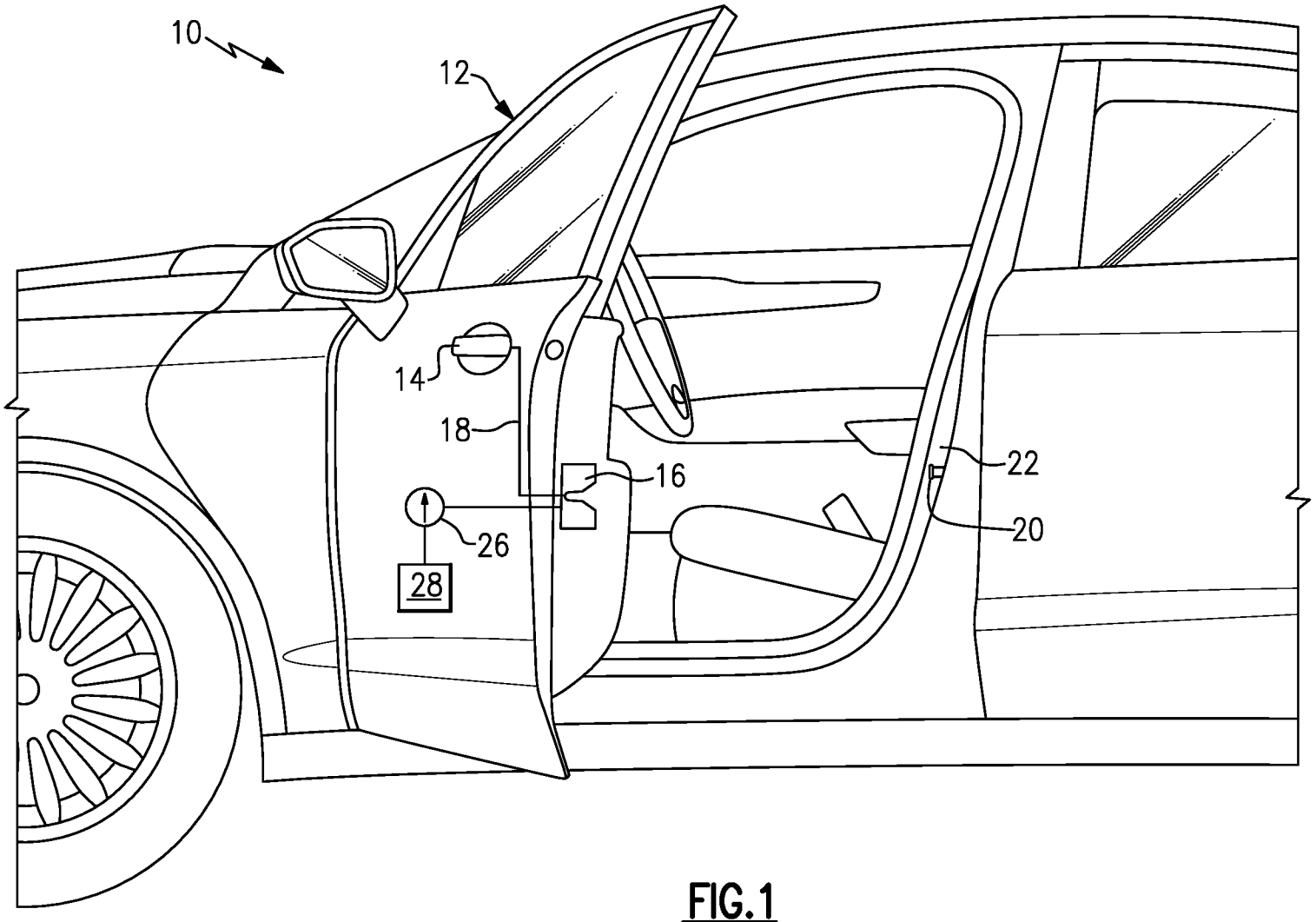
FIG. 1 is a side view of a portion of an exemplary motor vehicle.

Referring to the drawings, FIG. 1 is a side view of a portion of a motor vehicle 10 ("vehicle 10"), which in this example is a four door sedan. FIG. 1 shows a front driver door 12, which is configured to open and close relative to the body of the vehicle 10. The door 12 is open in FIG. 1, and includes a handle 14 on an exterior thereof. The handle 14 is coupled to a door latch 16 by way of a mechanism 18, such as a rod and/or a cable. The door latch 16 and mechanism 18 are shown schematically in FIG. 1.

When the door 12 is closed, the door latch 16 is configured to cooperate with a striker pin 20 to hold the door 12 closed. Upon activation of the handle 14, the door latch 16 is configured to release the striker pin 20 to allow the door 12 to open. The striker pin 20 is mounted to a vehicle body 22, and in particular is mounted to a pillar, such as a B-pillar.

The door latch 16 includes a clutch 24 (FIG. 2) selectively engaged by a magnetic field. In other words, the clutch 24 is engaged when a magnetic field is present. When the clutch 24 is engaged, the door 12 is unlocked, meaning the handle 14 can open the door 12. Specifically, when the clutch 24 is engaged, motion of the handle 14 is transmitted to the door latch 16 via the mechanism 18 such that the door latch 16 releases the striker pin 20. On the other hand, when a magnetic field is not present, the clutch 24 is disengaged, meaning the door 12 is locked and the handle 14 cannot be used to open the door 12. An example clutch 24 will be discussed in more detail below.

In this example, the magnetic field is generated by a magnetic field generator, which will be discussed below. One example magnetic field generator is an electromagnet, which produces a magnetic field using electric current. In this disclosure, the vehicle 10 includes a current source 26 electrically coupled to the door latch 16. The current source 26, in one example, is a circuit configured to deliver electric current to the door latch 16 in response to commands from a controller 28. The current source 26 and controller 28 are shown schematically in FIG. 1.

The controller 28 could be part of an overall vehicle control module, such as a vehicle system controller (VSC), or could alternatively be a stand-alone controller separate from the VSC. Further, the controller 28 may be programmed with executable instructions for interfacing with and operating the various components of the vehicle 10. The controller 28 additionally includes a combination of hardware and software, and specifically includes a processing unit and non-transitory memory for executing the various control strategies and modes of the vehicle system. While shown separately in FIG. 1, it should be understood that the controller 28 could include the current source 26.

While a sedan is shown in FIG. 1, it should be understood that this disclosure extends to all vehicle types, including cars, trucks, vans, sport utility vehicles (SUVs), etc. Further, while a four door vehicle is shown in FIG. 1, this disclosure extends to vehicles having at least one door. This disclosures is not limited to passenger doors, and extends to other types of doors, such as liftgates, tailgates, and cargo doors, as examples.

Figure 3:
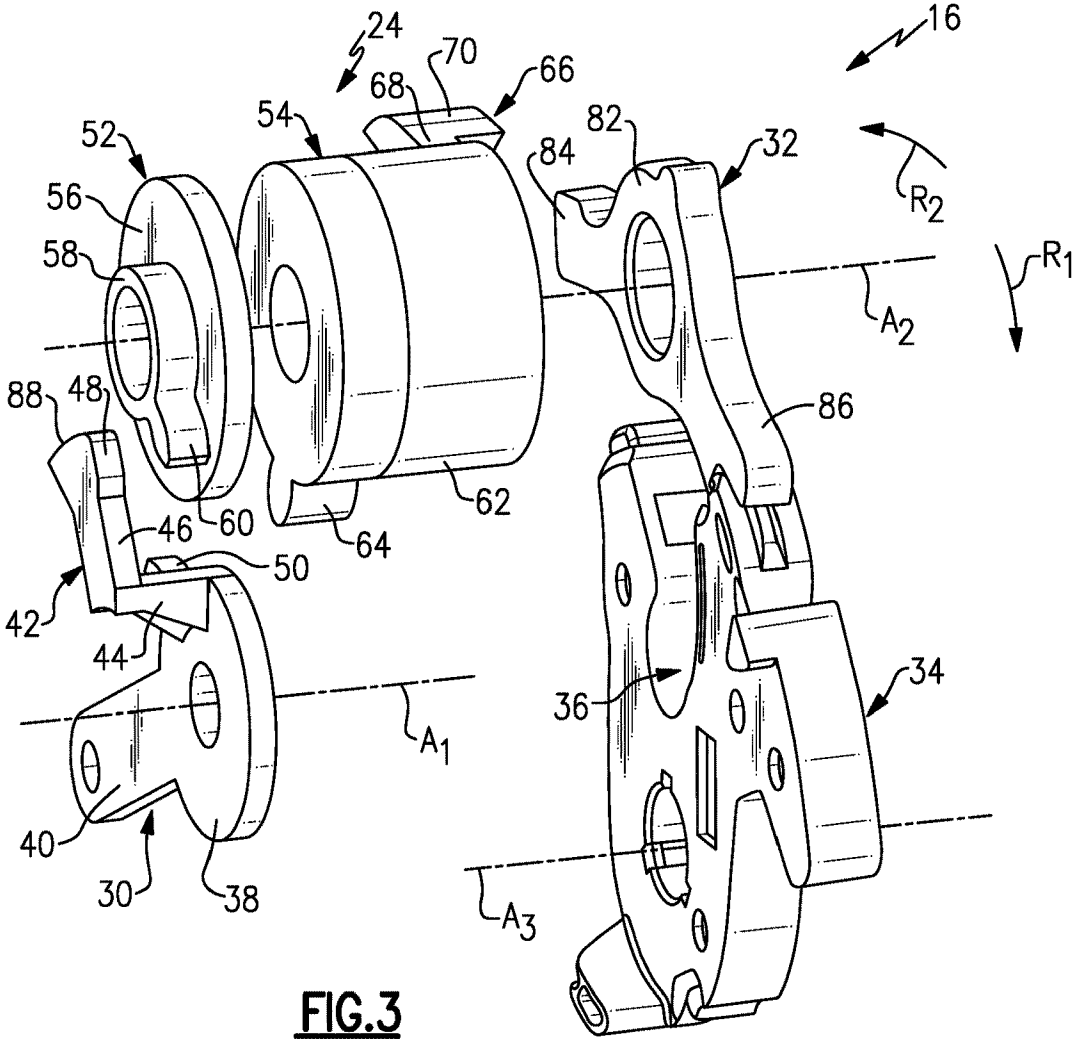
FIG. 3 is an exploded view of the door latch of FIG. 2.
Figure 2:
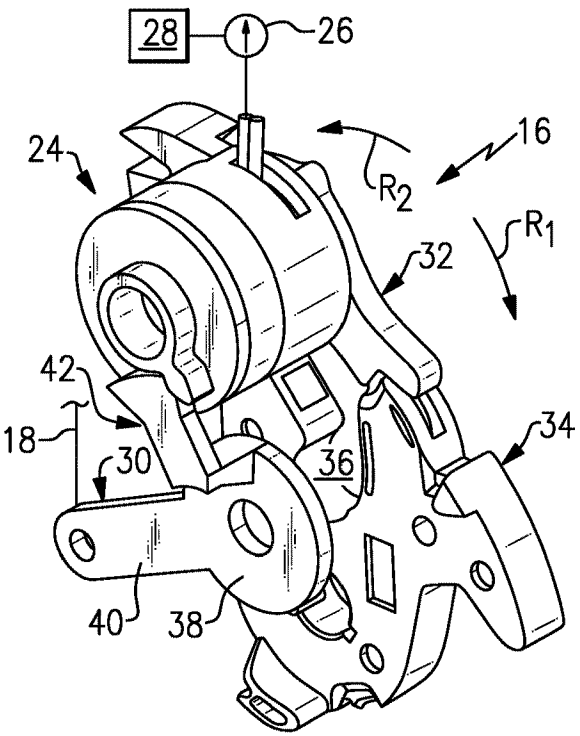
FIG. 2 is a perspective view of an example door latch.

FIG. 2 is a perspective view of an example door latch 16. FIG. 3 is an exploded view of the door latch 16. While FIGS. 2 and 3 illustrate the main components of the door latch 16, one skilled in this art would readily understand that the door latch 16 includes other components that are not illustrated in FIGS. 2 and 3. For example, the door latch 16 may include a plurality of springs, stops, shafts, etc., which are not illustrated. The door latch 16 is not limited to any particular arrangement of any components that are not shown in the figures.

With joint reference to FIGS. 2 and 3, the door latch 16 includes a release lever 30 configured to transmit motion to a pawl 32 by way of the clutch 24. The release lever 30 is mechanically coupled to the handle 14 via the mechanism 18. Further, the pawl 32 is configured to contact a fork bolt 34, which is configured to receive the striker pin 20 in a slot 36 thereof. In FIGS. 2 and 3, the door latch 16 is in a "door closed" position, which is representative of a position of the door latch 16 when the door 12 is closed. In the "door closed" position, the striker pin 20 would be received in the slot 36. The fork bolt 34 is held in the position of FIGS. 2 and 3 by the pawl 32 until a sufficient force is applied to the pawl 32 by the release lever 30 via the clutch 24. Each of the components of the door latch 16 shown in FIGS. 2 and 3 will now be described in more detail.

Turning first to the release lever 30, the release lever 30 includes a main body 38, which in this example is a substantially circular plate. The main body 38 is disposed about a first axis $A_1$, and the release lever 30 is rotatable about the first axis $A_1$. The main body 38 includes an opening, which may receive a shaft about which the release lever 30 rotates.

The release lever 30 includes a first arm 40 projecting radially outward (relative to the first axis $A_1$) from the main body 38. The first arm 40 is mechanically coupled to the handle 14 via the mechanism 18. The first arm 40 includes an opening near a free end thereof to couple to the mechanism 18. The opening in the first arm 40 is not required in all examples, however.

The mechanism 18 is configured to impart a force on the first arm 40, which causes the first arm 40, and in turn the release lever 30, to rotate in either a first rotational direction $R_1$ or a second rotational direction $R_2$. The first and second rotational directions $R_1$, $R_2$ are illustrated in the figures for explanation purposes. The first rotational direction $R_1$ is a clockwise direction relative to FIGS. 2 and 3, and the second rotational direction $R_2$ is a counter-clockwise direction. In this example, the release lever 30 is rotationally biased in the second rotational direction $R_2$ by way of a spring. The force a user imparts on the handle 14 is transmitted to the release lever 30 via the mechanism 18. The imparted force overcomes the bias force of the spring and rotates the release lever 30 in the first rotational direction $R_1$.

The release lever 30 also includes a second arm 42. The second arm 42 includes a first leg 44 projecting substantially parallel to the axis $A_1$. The first leg 44 projects in a direction opposite the pawl 32 and the fork bolt 34. The second arm 42 includes a second leg 46 projecting radially (relative to the axis $A_1$) from the first leg 44. Generally opposite the first leg 44, the second leg 46 includes a surface 48 adjacent a free end thereof. The surface 48 is configured to contact a tooth of the clutch 24, as explained below. The surface 48 has a profile shape of an involute, in this example.

The release lever 30 also includes a tooth 50 projecting radially outward from the main body 38. Like the surface 48, the tooth 50 may include a surface having an involute profile shape. The tooth 50 is perhaps best seen in FIG. 5A, for example. As shown in FIG. 5A, the tooth 50 is circumferentially spaced-apart about the first axis $A_1$ from the second arm 42. In particular, the tooth 50 is circumferentially between the first arm 40 and the second arm 42. Further, because of the first leg 44, the second arm 42 and the tooth 50 are spaced-apart from one another along the first axis $A_1$ and lie in different planes. Further still, the second arm 42 is longer (i.e., extends further from the axis $A_1$) than the tooth 50 in this example.

The release lever 30 is configured to contact the clutch 24. When the clutch 24 is engaged, motion of the release lever 30 is transmitted to the pawl 32 via the clutch 24. On the other hand, when the clutch 24 is not engaged, motion of the release lever 30 is not transmitted to the pawl 32.

In this disclosure, the clutch 24 includes a coupling wheel 52 and a pawl lifter 54. The coupling wheel 52 includes a main body 56, which is a substantially circular plate in this example. The coupling wheel 52 is rotatable about a second axis $A_2$. The second axis $A_2$ is spaced-apart from and substantially parallel to the first axis $A_1$. The coupling wheel 52 includes an opening concentric with the second axis $A_2$, and may receive a shaft therethrough. The coupling wheel 52 may be rotatable about the shaft.

The coupling wheel 52 further includes a circumferential rim 58 projecting from the main body 56 in a direction parallel to the second axis $A_2$. The circumferential rim 58 extends about the second axis $A_2$. The coupling wheel 52 includes a tooth 60 projecting radially from the circumferential rim 58. The tooth 60 is configured to contact the second arm 42 of the release lever 30. Like the surface 48, the tooth 60 may have an involute profile shape.

The coupling wheel 52 may be made of a metallic material, such as a ferrous metal, which is attracted to a magnetic field. Example materials include iron and iron alloys. Alternatively, the coupling wheel 52 may be made of plastic including a ferrous metal insert.

In this example, the coupling wheel 52 is rotationally biased in the first rotational direction $R_1$. The coupling wheel 52 may be rotationally biased in the first rotational direction $R_1$ by a dedicated spring. During operation, the second arm 42 of the release lever 30 is configured to contact the tooth 60 and impart a force to the coupling wheel 52 that overcomes the bias of the spring, thereby rotating the coupling wheel 52 in the second rotational direction $R_2$.

The pawl lifter 54 is provided by a main body 62, which is substantially cylindrical in this example. Like the coupling wheel 52, the pawl lifter 54 is also arranged about the axis $A_2$. The pawl lifter 54 and the coupling wheel 52 may be rotatable about a common shaft.

Adjacent the coupling wheel 52, the pawl lifter 52 includes a tooth 64 projecting radially from the main body 62. The tooth 64 is configured to contact the tooth 50 of the release lever 30. Like the tooth 50, the tooth 64 of the pawl lifter 54 may have a profile shape of an involute.

Adjacent the pawl 32, the pawl lifter 54 includes an arm 66 configured to contact the pawl 32. The arm 66 includes a first leg 68 projecting radially from the main body 62, and a second leg 70 projecting from the first leg 68 toward the pawl 32 in a direction substantially parallel to the axis $A_2$.

In this example, the pawl lifter 54 is rotationally biased in the first rotational direction $R_1$, like the coupling wheel 52. The pawl lifter 54 may be rotationally biased in the first rotational direction $R_1$ by a dedicated spring, which is separate from the spring biasing the coupling wheel 52. When the clutch 24 is engaged, rotation of the coupling wheel 52 in the second rotational direction $R_2$ overcomes the bias of the spring, thereby rotating the pawl lifter in the first rotational direction $R_1$. When the clutch 24 is disengaged (i.e., not engaged), rotation of the coupling wheel 52 does not result in rotation of the pawl lifter 54.

Figure 4:
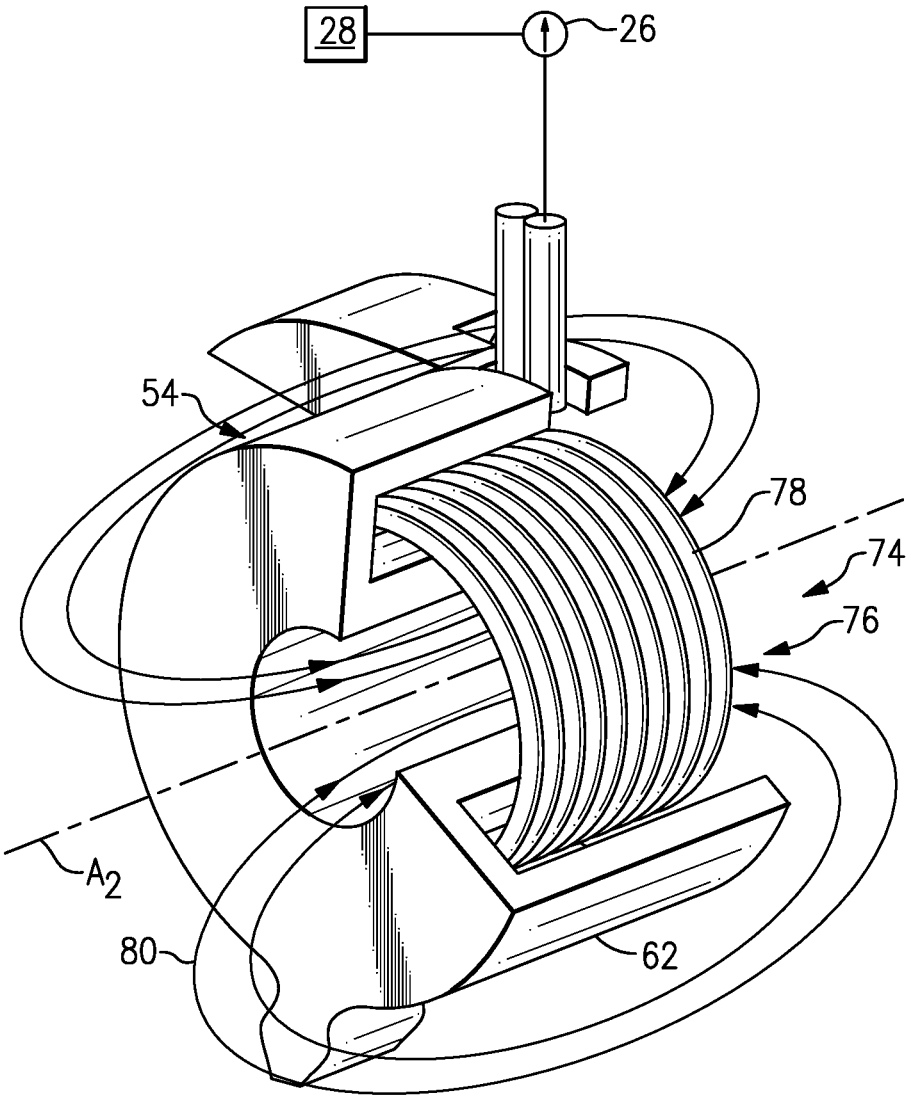
FIG. 4 is a partially sectioned view of a pawl lifter.

In one example of this disclosure, the door latch 16 includes a magnetic field generator 74. An example magnetic field generator 74 is shown in FIG. 4. In FIG. 4, the magnetic field generator 74 is provided by an electromagnet 76, which includes a coil 78 wrapped about the second axis $A_2$ within the main body 62 of the pawl lifter 54.

The electromagnet 76 is electrically coupled to the current source 26 and the controller 28. The controller 28 is configured to command the current source 26 to direct electric current through the coil 78, thereby generating a magnetic field 80 adjacent the pawl lifter 54. When present, the magnetic field 80 attracts the coupling wheel 52 to the pawl lifter 54 such that rotation of the coupling wheel 52 results in corresponding rotation of the pawl lifter 54.

While an electromagnet 76 is shown in FIG. 4, it should be understood that the coupling wheel 52 and pawl lifter 54 could be selectively coupled and uncoupled in other ways. For example, the coupling wheel 52 and pawl lifter 54 could include a magneto-rheological (MR) fluid. A magnetic field changes the viscosity of MR fluid. For example, when a magnetic field is present, the viscosity of the MR fluid increases, thereby coupling the coupling wheel 52 and pawl lifter 54. Again, this disclosure is not limited to the details of FIG. 4, and extends to other types of clutches.

Turning back to FIGS. 2 and 3, the pawl 32 includes a main body 82 disposed about the second axis $A_2$. The main body 82 may include an opening receiving the same shaft about which the coupling wheel 52 and pawl lifter 54 rotate. The pawl 32 further includes a first arm 84 projecting radially from the main body 82, and a second arm 86 projecting radially from the main body 82 in a direction substantially opposite the first arm 84. The first arm 84 is configured to contact the arm 66 of the pawl lifter 54. The second arm 86 is configured to contact the fork bolt 34 to hold the fork bolt 34 in place when in the "door closed" position. To this end, the pawl 32 is biased in the first rotational direction $R_1$ by a spring, for example. When the arm 66 of the pawl lifter 54 contacts the first arm 84 of the pawl 32, the pawl 32 rotates in the second rotational direction $R_2$ and releases the fork bolt 34, thereby allowing the door 12 to open.

The fork bolt 34 is configured for rotation about a third axis $A_3$, which is spaced-apart from and parallel to the first and second axes $A_1$, $A_2$. The fork bolt 34 is rotationally biased in the second rotational direction $R_2$ by a dedicated spring, for example. The pawl 32 is configured to hold the fork bolt 34 in the position of FIGS. 2 and 3 in order to maintain the "door closed" position. In that position, the striker pin 20 is within the slot 36. When the pawl 32 rotates in the second rotational direction $R_2$ and releases the fork bolt 34, the fork bolt 34 rotates in the second rotational direction $R_2$ under the bias of the respective spring, thereby allowing the door 12 to open.

Figure 5C:
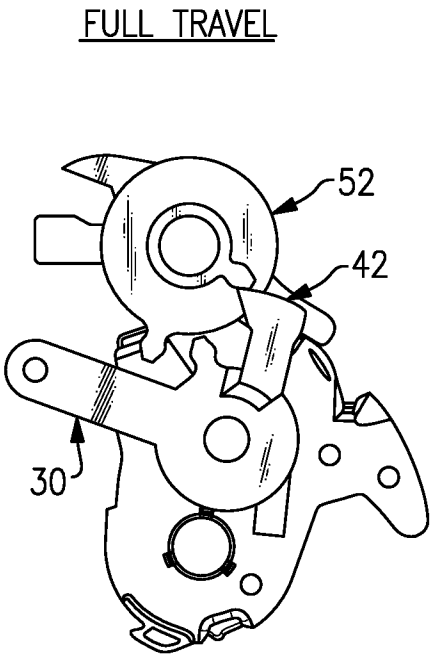
FIGS. 5A-5C and 6A-6D illustrate example sequences of the door latch in locked and unlocked states, respectively. In particular.
Figure 5B:
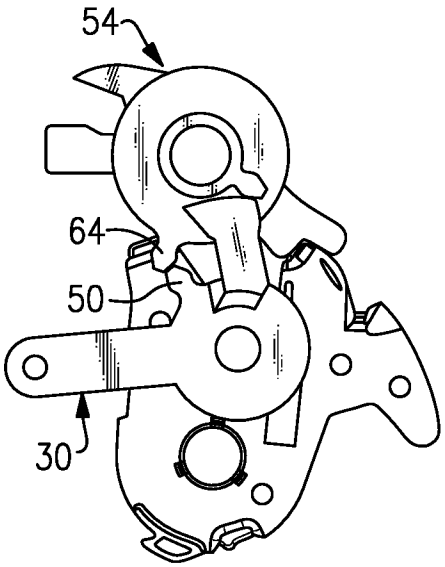
Figure 5A:
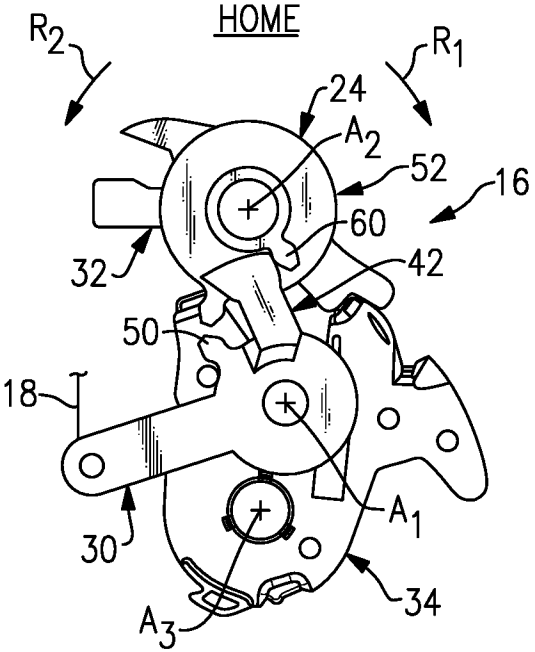

FIGS. 5A-5C and 6A-6D illustrate sequences in which a user attempts to open the door 12. FIGS. 5A-5C illustrate an example sequence in which the door 12 is locked. When the door 12 is locked, the clutch 24 is disengaged. In this state, the controller 28 commands the current source 26 to not direct current to the magnetic field generator 74.

FIG. 5A illustrates the door latch 16 in a "home" position. The "home" position is the same as the "door locked" position of FIGS. 2 and 3. In this position, the door 12 is closed, and the striker pin 20 is received within the slot 36 of the fork bolt 34. The pawl 32 holds the fork bolt 34 in place, thereby holding the door 12 closed.

When the door 12 is locked, a user should not be able to open the door 12 by pulling the handle 14. In FIG. 5A, a user pulls the handle 14, which causes the mechanism 18 to rotate the release lever 30 in the first rotational direction $R_1$. Such rotation causes the second arm 42 of the release lever 30 to contact the tooth 60 of the coupling wheel 52, which causes the coupling wheel 52 to rotate in the second rotational direction $R_2$, as shown in FIG. 5B.

Because the clutch 24 is disengaged, the coupling wheel 52 is not attracted to the pawl lifter 54, and thus rotation of the coupling wheel 52 does not result in any rotation of the pawl lifter 54. Thus, the tooth 50 of the release lever 30 does not contact the tooth 64 of the pawl lifter 54 as the tooth 50 rotates in the first rotational direction $R_1$. In other words, the tooth 50 bypasses (FIG. 5B is labeled "bypass" for this reason) the tooth 64.

As the release lever 30 continues to rotate to a full travel position, as shown in FIG. 5C, the second arm 42 continues to rotate the coupling wheel 52, but, again, that rotation does not result in rotation of the pawl lifter 54. Thus, the pawl 32 stays in place, and does not release the fork bolt 34, thereby keeping the door 12 closed.

Figures 6A, 6B, 6C, 6D:
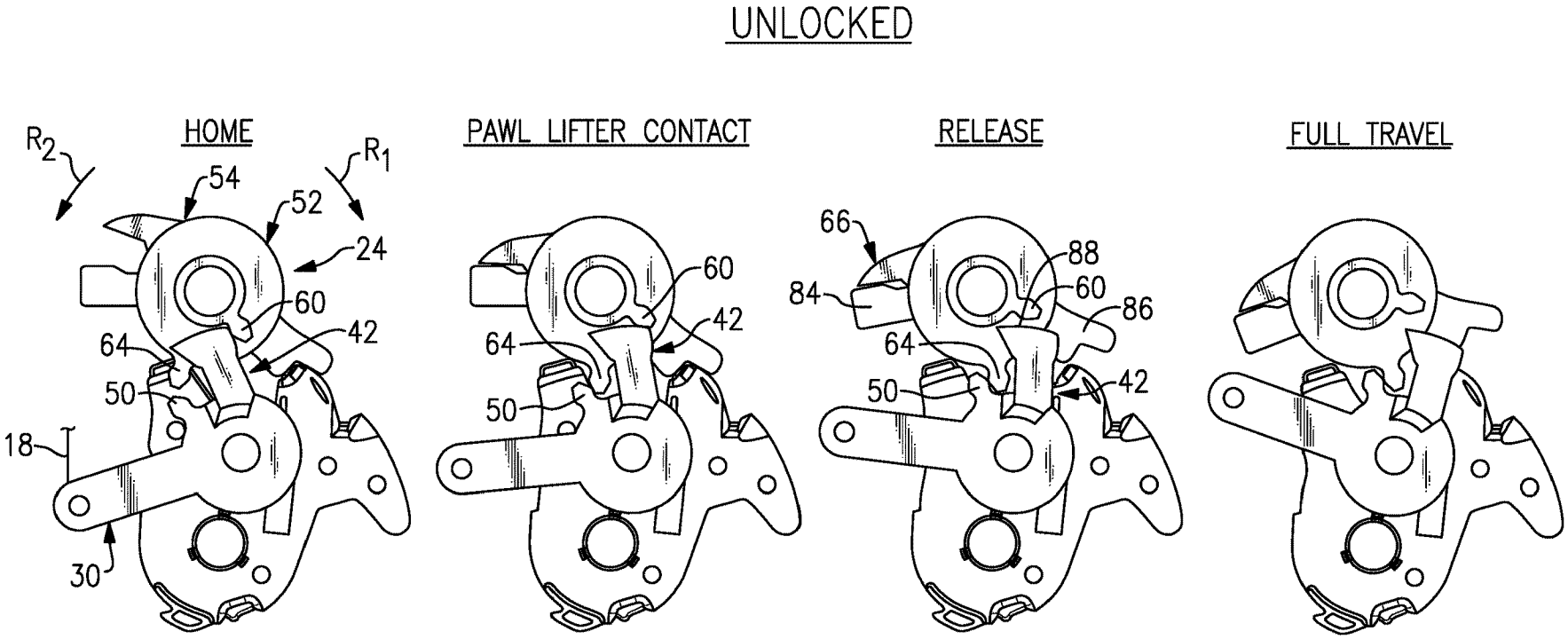

When the door 12 is unlocked, a user should be able to open the door 12 by pulling the handle 14. With reference to FIG. 6A, the door latch 16 is in the same "home" position of FIG. 5A. However, in FIG. 6A, the controller 28 has commanded the current source 26 to direct current to the magnetic field generator 74. Thus, the clutch 24 is engaged, and the coupling wheel 52 is attracted to the pawl lifter 54.

Upon application of force by the mechanism 18, the release lever 30 begins to in the first rotational direction $R_1$ to a first rotational position, shown in FIG. 6B. In the first rotational position, the release lever 30 has rotated the coupling wheel 52 in the second rotational direction $R_2$ by virtue of the contact between the second arm 42 and the tooth 60. Further, because the clutch 24 is engaged, the pawl lifter 54 has also rotated in the second rotational direction $R_2$. Thus, in the first rotational position of FIG. 6B, the release lever 30 contacts the pawl lifter 54 (hence FIG. 6B being labeled "pawl lifter contact"). Specifically, the tooth 50 contacts the tooth 64.

As shown in FIG. 6C, continued rotation of the release lever 30 in the first rotational direction $R_1$ causes the arm 66 of the pawl lifter 54 to come into contact with the first arm 84 of the pawl 32. Further, the second arm 42 releases from (i.e., ceases to contact) the tooth 60. The release lever 30 remains in contact with the pawl lifter 54, however, by way of contact between the teeth 50, 64. This "handoff" of sorts is beneficial because continued rotation of the pawl lifter 54 may require a more robust mechanical connection than that provided between the coupling wheel 52 and the pawl lifter 54. Thus, the functionality of the door latch 16 is not entirely reliant on the magnetic attraction between the coupling wheel 52 and the pawl lifter 54.

While the second arm 42 has released from the tooth 60, it is desirable to prevent the tooth 60 from rotating to the wrong side of the second arm 42. Thus, the free end 88 second arm 42 has a substantially large circumferential dimension (i.e., width). The second arm 42, in this example, continuously increases in dimension such that the free end 88 has the largest circumferential dimension of the entire second arm 42. The increased circumferential dimension will catch the tooth 60, preventing it from rotating beyond the second arm 42 in the rotational direction $R_1$. Thus, the arrangement allows the door latch 16 to properly reset to the home position.

Continued rotation causes the pawl lifter 54 to rotate the pawl 32 in the second rotational direction $R_2$ such that the pawl 32 releases the fork bolt 34, as shown in the second rotational position of FIG. 6D. The second rotational position is a full travel position of the release lever 30. In the second rotational position, the pawl 32 releases the fork bolt 34, and the door 12 is allowed to open.

It should be understood that terms such as "about," "substantially," and "generally" are not intended to be boundaryless terms, and should be interpreted consistent with the way one skilled in the art would interpret those terms. It should also be understood that terms such as "axial," "radial," "circumferential," etc., are used herein relative to the orientation of the door latch 16 in the figures for purposes of explanation only, and should not be deemed limiting.

Although the different examples have the specific components shown in the illustrations, embodiments of this disclosure are not limited to those particular combinations. It is possible to use some of the components or features from one of the examples in combination with features or components from another one of the examples. In addition, the various figures accompanying this disclosure are not necessarily to scale, and some features may be exaggerated or minimized to show certain details of a particular component or arrangement.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A door latch for a motor vehicle, the door latch comprising:

a pawl;

a release lever; and a clutch selectively engaged by a magnetic field, and, when the clutch is engaged by the magnetic field, motion of the release lever is transmitted to the pawl via the clutch, wherein the clutch includes a coupling wheel and a pawl lifter, wherein the coupling wheel is configured to contact the release lever, wherein the pawl lifter is configured to contact the pawl, and wherein, when the clutch is engaged by the magnetic field, the magnetic field attracts the coupling wheel to the pawl lifter such that rotation of the coupling wheel results in corresponding rotation of the pawl lifter.

2. The door latch as recited in claim 1, wherein, when the clutch is disengaged, motion of the release lever is not transmitted to the pawl.

3. The door latch as recited in claim 1, wherein, when the clutch is disengaged, motion of the coupling wheel is not transmitted to the pawl lifter.

4. The door latch as recited in claim 1, further comprising a magnetic field generator configured to selectively generate the magnetic field.

5. The door latch as recited in claim 4, wherein the magnetic field generator includes an electromagnet at least partially within the pawl lifter.

6. The door latch as recited in claim 5, wherein the coupling wheel includes a material attracted to the magnetic field such that, when the magnetic field is present, rotation of the coupling wheel results in rotation of the pawl lifter.

7. The door latch as recited in claim 1, wherein:

the release lever includes an arm and a tooth, the coupling wheel includes a tooth configured to contact the arm of the release lever, and the pawl lifter includes a tooth configured to contact with the tooth of the release lever.

8. The door latch as recited in claim 7, wherein the arm of the release lever is longer than the tooth of the release lever, and the arm of the release lever is circumferentially and axially spaced-apart from the tooth of the release lever.

9. The door latch as recited in claim 7, wherein, when the clutch is engaged by the magnetic field:

the arm of the release lever contacts the tooth of the coupling wheel as the release lever rotates from a home position to a first rotational position, and the tooth of the release lever contacts the tooth of the pawl lifter as the release lever rotates from the first rotational position to a second rotational position.

10. The door latch as recited in claim 9, wherein, when the clutch is engaged by the magnetic field, the arm of the release lever releases from the tooth of the coupling wheel at a point between the first rotational position and the second rotational position.

11. The door latch as recited in claim 9, wherein, when the clutch is engaged by the magnetic field, rotation of the release lever to the second rotational position causes the pawl lifter to contact the pawl such that the pawl releases a fork bolt.

12. The door latch as recited in claim 11, wherein the pawl lifter includes an arm configured to contact the pawl.

13. The door latch as recited in claim 9, wherein, when the clutch is disengaged:

the arm of the release lever contacts the tooth of the coupling wheel as the release lever rotates, and the tooth of the release lever bypasses the tooth of the pawl lifter as the release lever rotates.

14. The door latch as recited in claim 1, wherein:

when a door of the motor vehicle is closed, the door latch is configured to cooperate with a striker pin to hold the door closed, and upon activation of a handle of the door, the door latch is configured to release the striker pin to permit the door to open.

15. A motor vehicle, comprising:

a body including a striker pin;

a door configured to open and close relative to the body, the door including a door latch, the door latch including:

a fork bolt configured to receive the striker pin when the door is closed, a pawl configured to hold the fork bolt to keep the door closed, a release lever, and a clutch selectively engaged by a magnetic field, wherein the clutch includes a coupling wheel and a pawl lifter, and wherein, when the clutch is engaged by the magnetic field, the magnetic field attracts the coupling wheel to the pawl lifter such that rotation of the coupling wheel results in corresponding rotation of the pawl lifter and such that motion of the release lever is transmitted to the pawl via the clutch and such that the pawl releases the fork bolt, thereby allowing the door to open.

16. The motor vehicle as recited in claim 15, wherein the door includes a door handle, and wherein the release lever is coupled to the door handle.

17. The motor vehicle as recited in claim 16, wherein:

when the door is closed, the door latch is configured to cooperate with the striker pin to hold the door closed, and upon activation of the handle, the door latch is configured to release the striker pin to permit the door to open.

18. A method, comprising:

engaging a clutch by generating a magnetic field; and transmitting motion of a release lever to a pawl via the clutch, the pawl configured to release a fork bolt, thereby allowing a door to open, wherein the clutch includes a coupling wheel and a pawl lifter, and wherein the step of transmitting motion includes:

using the magnetic field to attract the coupling wheel to the pawl lifter such that rotation of the coupling wheel results in corresponding rotation of the pawl lifter, rotating the release lever from a home position to a first rotational position, the release lever contacting the coupling wheel between the home position and the first rotational position, and rotating the release lever from the first rotational position to a second rotational position, the release lever contacting the pawl lifter between the first rotational position and the second rotational position.

19. The method as recited in claim 17, further comprising:

releasing the release lever from the coupling wheel at a point between the first rotational position and the second rotational position.

20. The method as recited in claim 17, further comprising: disengaging the clutch by ceasing to generate a magnetic field, thereby preventing transmission of motion of the release lever to the pawl.

* * * * *